US006354795B1

(12) United States Patent
White et al.

(10) Patent No.: US 6,354,795 B1
(45) Date of Patent: Mar. 12, 2002

(54) SHROUD COOLING SEGMENT AND ASSEMBLY

(75) Inventors: Gregory Alan White; Ching-Pang Lee, both of Cincinnati, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/627,050

(22) Filed: Jul. 27, 2000

(51) Int. Cl.[7] ..... F04D 31/00
(52) U.S. Cl. ..... 415/116; 415/116; 415/170.1
(58) Field of Search ..... 415/116, 115, 415/170.1, 185

(56) References Cited

U.S. PATENT DOCUMENTS

| | | | | |
|---|---|---|---|---|
| 3,777,484 | A | 12/1973 | Dibelius et al. | 60/39.65 |
| 3,825,364 | A | 7/1974 | Halila et al. | 415/116 |
| 4,127,357 | A | 11/1978 | Patterson | 415/116 |
| 4,157,232 | A | 6/1979 | Bobo et al. | 415/116 |
| 4,177,004 | A | 12/1979 | Riedmiller et al. | 415/116 |
| 4,303,371 | A | 12/1981 | Eckert | 415/116 |
| 4,526,226 | A | 7/1985 | Hsia et al. | 165/109 |
| 4,573,865 | A | 3/1986 | Hsia et al. | 415/115 |
| 5,071,313 | A | 12/1991 | Nichols | 415/134 |
| 5,074,748 | A | 12/1991 | Hagle | 415/170.1 |
| 5,088,888 | A | 2/1992 | Bobo | 415/170.1 |
| 5,116,199 | A | 5/1992 | Ciokajlo | 415/173.2 |
| 5,127,793 | A | 7/1992 | Walker et al. | 415/115 |
| 5,165,847 | A | 11/1992 | Proctor et al. | 415/115 |
| 5,169,287 | A | 12/1992 | Proctor et al. | 415/115 |
| 5,188,506 | A | 2/1993 | Creevy et al. | 415/115 |
| 5,273,396 | A | 12/1993 | Albrecht et al. | 415/173.1 |
| 5,391,052 | A | 2/1995 | Correia et al. | 415/115 |
| 5,480,281 | A | 1/1996 | Correia | 415/115 |
| 5,584,651 | A | 12/1996 | Pietraszkiewicz et al. | 415/115 |
| 5,641,267 | A | 6/1997 | Proctor et al. | 415/173.1 |
| 5,993,150 | A | 11/1999 | Liotta et al. | 415/115 |

*Primary Examiner*—F. Daniel Lopez
*Assistant Examiner*—Kimya N McCoy
(74) *Attorney, Agent, or Firm*—Andrew C. Hess; William Scott Ande

(57) ABSTRACT

A cooling shroud segment for a high pressure turbine that provides improved cooling in the region of the side panels from the midsection thereof forward to the leading edge and particularly in the midsection of the side panel. A shroud subassembly can be formed from a pair of such adjacent shroud segments with opposed adjacent side panels where the spacing of the outlets of the cooling air passages exiting from each of these adjacent side panels are staggered and where the adjacent panels have a spline seal slot with a humped section in at least the midsection of the side panel above and across the outlets of the cooling air passages exiting from the midsection of the side panel, in combination with a spline seal positioned in the gap between the opposed adjacent side panels. This shroud subassembly provides more uniform impingement cooling coverage and localizes more of the cooling air exiting the outlets from these passages in the midsection of the opposed side panels.

15 Claims, 10 Drawing Sheets

SHROUD COOLING SEGMENT AND ASSEMBLY

BACKGROUND OF THE INVENTION

The present invention relates generally to a turbine engine cooling component such as a shroud cooling segment useful in turbine engines such as high pressure turbines. The present further relates to a turbine cooling subassembly that uses a pair of such turbine components in combination with at least one spline seal.

To increase the efficiency of gas turbine engines, a known approach is to raise the turbine operating temperature. As operating temperatures are increased, the thermal limits of certain engine components can be exceeded, resulting in material failure or, at the very least, reduced service life. In addition, the increased thermal expansion and contraction of these components adversely affects clearances and their interfitting relationships with other components of different thermal coefficients of expansion. Consequently, these components should be cooled to avoid potentially damaging consequences at elevated operating temperatures.

It is common practice then to extract from the main airstream a portion of the compressed air at the output of the compressor for cooling purposes. So as not to unduly compromise the gain in engine operating efficiency achieved through higher operating temperatures, the amount of extracted cooling air should be held to a small percentage of the total main airstream. This requires that the cooling air be utilized with the utmost efficiency in maintaining the temperatures of these components within safe limits.

A particularly important component subjected to extremely high temperatures is the shroud located immediately downstream of the high pressure turbine nozzle from the combustor. The shroud closely surrounds the rotor of the high pressure turbine and thus defines the outer boundary of the extremely high temperature, energized gas stream flowing through the high pressure turbine. To prevent material failure and to maintain proper clearance with the rotor blades of the high pressure turbine, adequate shroud cooling is an important concern.

Shroud cooling is typically achieved by impingement cooling of the back surface of the shroud, as well as by drilling cooling holes that extend from the back surface of the base of the shroud and through to the forward or leading shroud, the bottom or inner surface of the base in contact with the main (hot) gas stream and the side panels or rails of the shroud to provide both convection cooling inside the holes, as well as impingement and film cooling. See, for example, commonly assigned U.S. Pat. No. 5,169,287 (Proctor et al), issued Dec. 8, 1992, which shows an embodiment of shroud cooling of the high pressure turbine section of one type of gas turbine. This cooling minimizes local oxidation and burning of the shrouds near the hot main or core (hot) gas stream in the high pressure turbine. Indeed, the cooling holes that exit through the side panels of the shroud of commonly assigned U.S. Pat. No. 5,169,287 can provide important impingement cooling to the side panel of the adjacent shroud.

While impingement cooling of the entire length of the side panel of the adjacent shroud is desirable, it has been found to be particularly important to provide impingement cooling to the side panels from about the midsection of thereof forward to the leading edge of the shroud, and especially in the region of the midsection of this side panel. It has been discovered that, for some high pressure turbines, the hottest point of the main gas stream tends to localize in the region around this midsection. This means that the greatest opportunity for undesired oxidation and burning of the shroud can occur at this point.

One approach to shroud cooling is disclosed in commonly assigned U.S. Pat. No. 5,169,287. See, in particular, FIG. 2 of U.S. Pat. No. 5,169,287 which shows a pattern of three rows cooling holes or passages 82, 84 and 86 that are formed in shroud segment 22 and extend from back surface 44a of base 44 and exit through the inner surface 44b of base 44, the forward or leading edge or end 45 and one side panel or rail 50. As also shown in FIG. 2 of U.S. Pat. No. 5,169,287, a majority of these cooling passages are skewed in a direction such that the exit holes are opposed to the direction of the main gas stream to minimize the ingestion of the hot gases from this stream into the passages of rows 82, 84 and 86. The set of three passages, indicated by 88, that exit through the one side panel 50 provide a flow of cooling air that impinges against the side panel of the adjacent shroud segment. However, because the cooling passages exit through only one of the side panels, impingement cooling is provided to only one of the side panels of each adjacent pair of shrouds in the shroud assembly of U.S. Pat. No. 5,169,287.

Another prior approach to shroud cooling is shown in FIG. 1 of the present application. The prior shroud of FIG. 1 has a pattern of three rows of cooling holes or passages 182, 184 and 186 that are formed in shroud segment 122 that again exit from the inner surface of base 144, the forward or leading edge or end 145 and one side panel or rail 150. A set of five passages, indicated by 188, exit through one of the side panels 150 but in direction perpendicular to this side panel and also perpendicular to the main gas stream. As a result, there is a tendency for these passages 188 in the prior shroud of FIG. 1 to ingest hot gases from this stream, thus increasing the chance of undesired oxidation and burning of the shroud. Also, and like the shroud disclosed in U.S. Pat. No. 5,169,287, the cooling passages 188 again exit through only one of the side panels of the prior shroud of FIG. 1, so that impingement cooling is provided to only one of the side panels of each adjacent pair of shrouds in the shroud assembly.

As shown in FIG. 2 of the present application, the side panels 150 of the prior shroud of FIG. 1 has three spline seal slots formed therein hereinafter referred to as bottom spline seal slot 192, top spline seal slot 194 and back spline seal slot 196. Each of these slots 192, 194 and 196 receive one edge, respectively, of the bottom, top and back spline seals (not shown) that are positioned in the gap between each adjacent pairs of shrouds. These spline seals generally conform to or assume the same shape as the respective slots 192, 194 and 196 and extend generally the length each of the respective side panels 150 from the forward or leading edge or end 145 to the aft or trailing edge or end 148 of the shroud. As also shown in FIG. 2, bottom slot 192 has a plateau shaped or "humped" section 198 that curves upwardly in the forward section of the shroud before reaching exit holes 188, extends across and above holes 188, and then curves downwardly once past holes 188 in the aft section of the shroud. The bottom spline seal received by slot 192 also generally conforms to the shape of section 198 and thus has a "humped" or "hooded" section. As a result, the cooling air exiting holes 188 tends to be localized in the region of this humped section 198 of the bottom spline seal.

Yet another prior approach to shroud cooling is shown in FIG. 3 of the present application. The prior shroud of FIG. 3 has a pattern of three rows of cooling holes or passages 282, 284 and 286 that are formed in shroud segment 222 and again exit through the inner surface of base 244, the forward or leading edge or end 245 and one side panel or rail 250. A set of three passages, indicated by 288, extend through one of the side panels 250, the one closest to the leading edge 245 being skewed in a direction opposed to the main gas stream, the next passage being perpendicular to this side section and also perpendicular to the main gas stream and the last passage closest to the aft or trailing edge or end 248 being skewed in a direction that generally follows the main gas stream. Another set of two passages, indicated by 289, extend through the other side panel 250, both passages being perpendicular to this side panel and also perpendicular to the main gas stream. Because passages 288 and 289 exit through both side panels 250, the prior shroud shown in FIG. 3 provides impingement cooling to both of the side panels of each adjacent pair of shrouds in the shroud assembly. However, because one or two of the passages for each of the sets 288 and 289 are perpendicular to the side panels 250 and are located in the midsection of side panels 250 (i.e., the hottest point of the main gas stream), the prior shroud of FIG. 3 will again tend to ingest hot gases from this stream, thus increasing the chance of undesired oxidation and burning of the shroud.

As shown in FIGS. 4 and 5 of the present application, each of the side panels 250 of the prior shroud of FIG. 3 has two spline seal slots hereinafter referred to as bottom spline seal slot 292 and top spline seal 294 that again extend generally the length each of the respective side panels 250 from the forward or leading edge or end 245 to the aft or trailing edge or end 248 of the shroud. Again, each of these slots 292 and 294 receive one edge, respectively, of the bottom and top spline seals (not shown) that are positioned in the gap between each adjacent pair of shrouds in the shroud assembly. These spline seals again generally conform to or assume the same shape as the respective slot 292 and 294. As also shown in FIGS. 4 and 5, slot 292 also has a plateau shaped or "humped" section 298. In FIGS. 4 and 5, this "humped" section of slot 292 (and the respective spline seal) curves upwardly in the forward section of the shroud before reaching exit holes 288, 289), extends across and above holes 288, 289, and then curves downwardly once past holes 288, 289 in the aft section of the shroud so that cooling air exiting these holes is localized in the region of this humped section 298.

Yet a further prior approach to shroud cooling is shown in FIG. 6 of the present application. The prior shroud of FIG. 6 has a pattern of three rows cooling holes or passages 382, 384 and 386 that are formed in shroud segment 322 and exit through the inner surface of base 344, the forward or leading edge 345, the aft or trailing edge 348, and the side panels or rails 350. A set of three passages, indicated by 388, exit through one of the side panels 350, and are skewed in a direction opposed to the main gas stream. However, the passage 388 closest to the trailing edge is perpendicular to the side panel or only slightly skewed in the direction opposed to the main gas stream. Another set of two passages, indicated by 389, extend through the other side panel 350, both being skewed in a direction opposed to the main gas stream. Because passages 388 and 389 exit through both side panels 350, the prior shroud of FIG. 6 provides impingement cooling to both of the side panels of each adjacent pair of shrouds in the shroud assembly. However, most of the passages 388 and 389 also exit side panels 350 in the forward section of the prior shroud of FIG. 6. As a result, most of the cooling air exiting these holes 388 and 389 tends to be localized in the forward section of the prior shroud of FIG. 6. Also, as shown in FIGS. 7 and 8, the spline seal slot 392 in side panels 350 of the prior shroud of FIG. 6 has an L-shaped section 398 that extends across and above the exit holes 388 and 389, respectively, but curves downwardly about midpoint of panel 350. (Also shown in FIGS. 7 and 8 are top seal slot 394 and aft seal slot 396.) As a result, the spline seal received by slot 392 of each panel also conforms to the shape of section 398 and thus tends to localize the cooling air exiting holes 388 and 389 in the forward section of the prior shroud of FIG. 6, i.e., towards the leading edge 345 of the shroud. In addition, because section 398 of slot 392 is further up side panel 350, more of leading edge 345 of the shroud is exposed to the hot gas from the main gas stream, thus potentially requiring additional cooling air to be used.

Accordingly, it would desirable, therefore, to provide a shroud and resulting shroud assembly for a high pressure turbine that provides cooling air that exits holes or passages in the shroud that minimizes or avoids hot gas ingestion and localizes more of the cooling air exiting from these holes or passages in the region of the side panels from about the midpoint thereof forward to the leading edge and particularly in the region about the midpoint of the side panel. It would also be desirable to provide a shroud and shroud assembly where the cooling air exiting from these holes or passages provides more uniform impingement cooling to each side panel of each adjacent pair of shrouds of the shroud assembly, particularly in the region about the midpoint of each respective side panel.

SUMMARY OF THE INVENTION

The present invention relates to a turbine engine cooling component such as a cooling shroud segment for turbine engines such as high pressure turbines that provides improved cooling in the region of the side panels from the midsection thereof forward to the leading edge and particularly in the midsection of the side panel, while minimizing or avoiding hot gas ingestion by the cooling holes or passages exiting such side panels. This turbine engine components comprises:

(a) a circumferential leading edge;

(b) a circumferential trailing edge spaced from the leading edge;

(c) an arcuate base connected to the trailing and leading edges and having a back surface and an arcuate inner surface that is in contact with the main (hot) gas stream of the turbine engine moving in the direction from the leading edge to the trailing edge of the turbine component;

(d) a pair of spaced opposed side panels connected to the leading and trailing edges, each of the side panels having a leading section, a midsection and a trailing section;

(e) a plurality of cooling air passages extending through the base from the back surface thereof and having outlets exiting from at least one of the leading edge, the side panels and the inner surface of the base;

(f) wherein all of the plurality of cooling air passages having outlets that exit from the leading or midsections of each side panel are skewed so that cooling air exits therefrom in a direction opposed to the main hot gas stream;

(g) wherein at least one of the plurality of cooling air passages has an outlet that exits in the midsection of each side panel; and (h) a spline seal slot that extends from the leading section to the trailing section of the side panel and has a humped section in at least the midsection of the side panel that is above and across at least the outlets of the cooling air passages exiting from the midsection of the side panel.

The present invention further relates to a turbine cooling subassembly comprising a pair of such adjacent turbine components, and having:

(a) opposed adjacent side panels having a gap therebetween and wherein the spacing of the outlets of the cooling air passages exiting from each of the adjacent side panels is staggered such that the outlet of each passage exiting from one of the adjacent panels is not directly opposite outlet of each cooling air passage exiting from the other of the adjacent side panels;

(b) at least one spline seal positioned in the gap between the opposed adjacent side panels and including a pair of spaced edges having a length and thickness such that each of the edges is capable of being received by the slot of one of the adjacent side panels.

The turbine cooling component of the present invention is particularly useful in providing effective, efficient and more uniform cooling, especially to the midsection of the shroud where the temperature of the main hot gas stream tends to be hottest in a high pressure turbine. The skewing of the cooling air passages exiting the side panels in the midsection to forward section of the shroud in a direction opposed to the main gas stream also minimizes or avoids hot gas ingestion by such passages. The turbine cooling subassembly of the present invention that comprises a pair of such turbine components that have staggered or offset outlets for the cooling air passages exiting from the adjacent side panels also provides more uniform impingement cooling coverage. The turbine cooling of the present invention also localizes more of the cooling air exiting these passages in the midsection of the side panels, due to the spline seal slot having the humped section that causes the respective spline seal positioned in the gap between these adjacent shroud segments to also have a humped or hooded configuration.

BRIEF DESCRIPTION OF THE DRAWINGS

FIG. 9 is an axial sectional view of a shroud cooling assembly that the shroud segment and subassembly of the present invention can be used in.

DETAILED DESCRIPTION OF THE INVENTION

Figure 1:
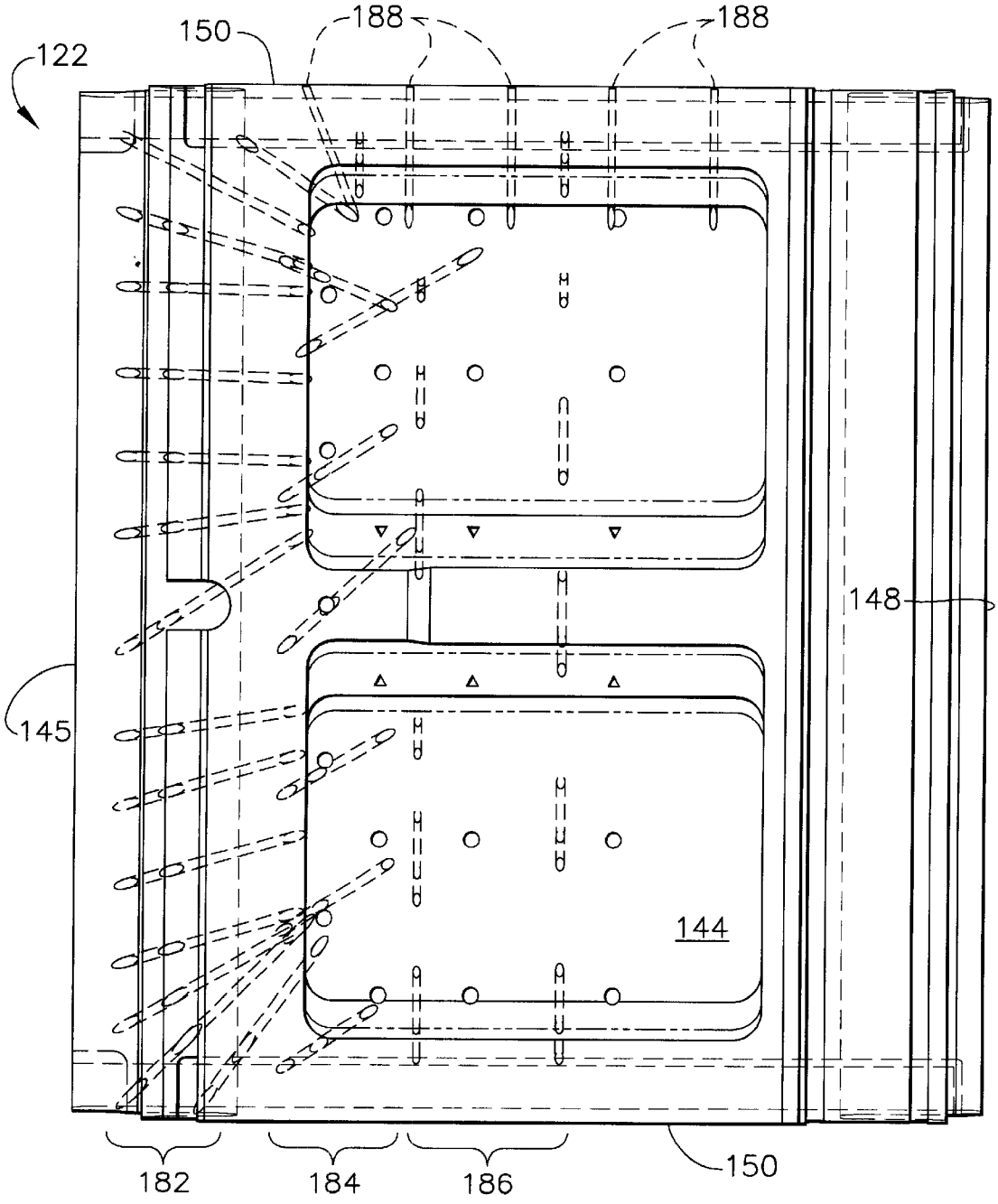
FIG. 1 (PRIOR ART)
FIG. 1 is a plan view of a prior shroud.
Figure 2:
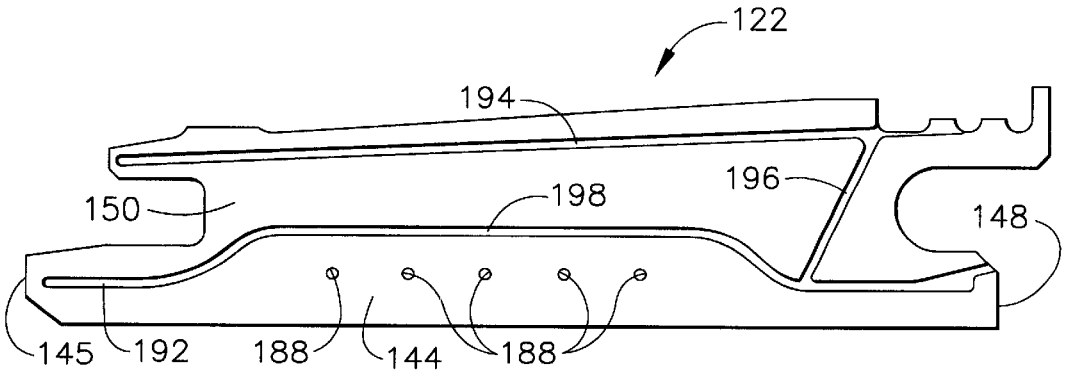
FIG. 2 (PRIOR ART)
FIG. 2 is a side view of the prior shroud of FIG. 1.
Figure 4:
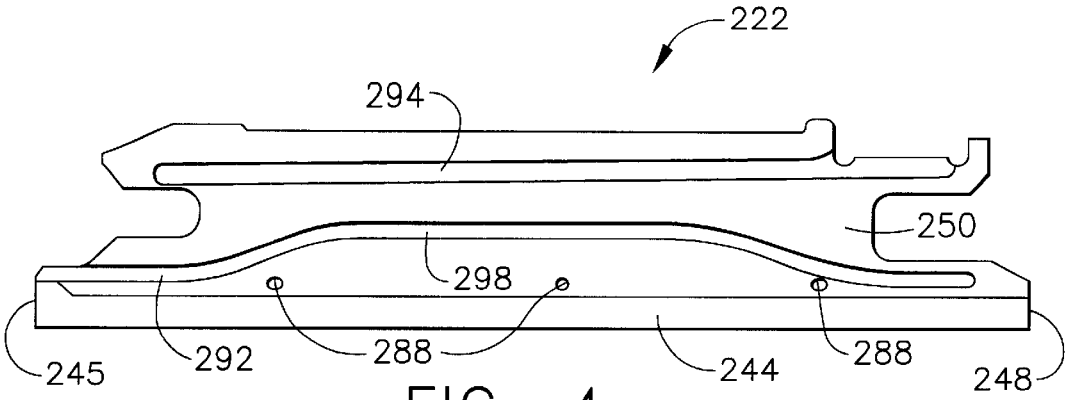
FIG. 4 (PRIOR ART)
FIGS. 4 and 5 are different side views of the prior shroud of FIG. 3.
Figure 5:
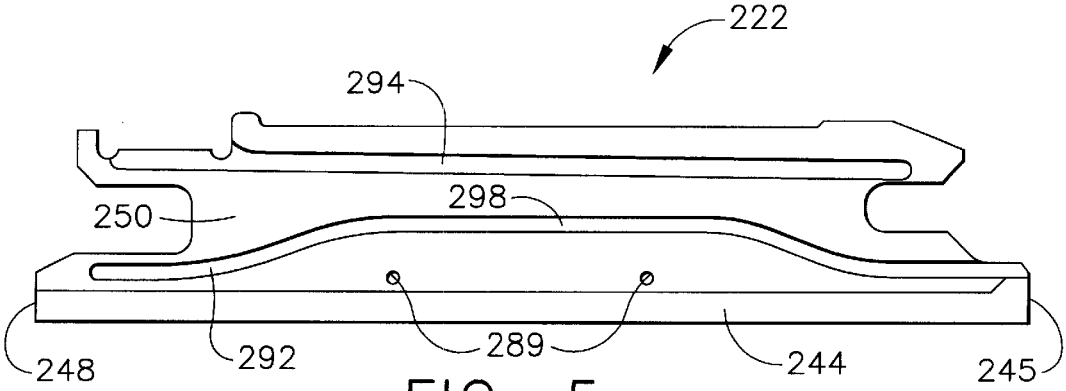
FIG. 5 (PRIOR ART)
Figure 3:
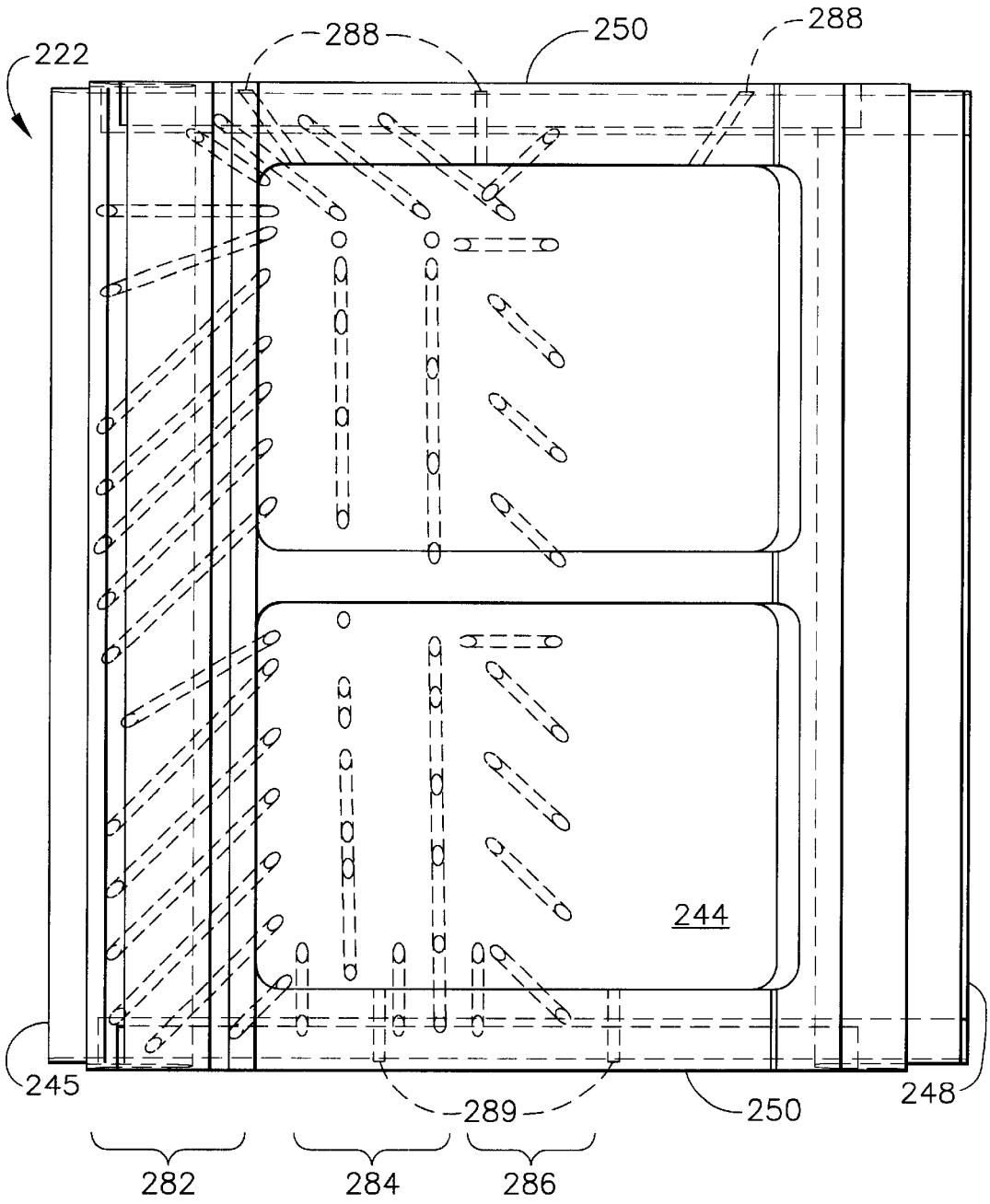
FIG. 3 (PRIOR ART)
FIG. 3 is a plan view of another prior shroud.
Figure 6:
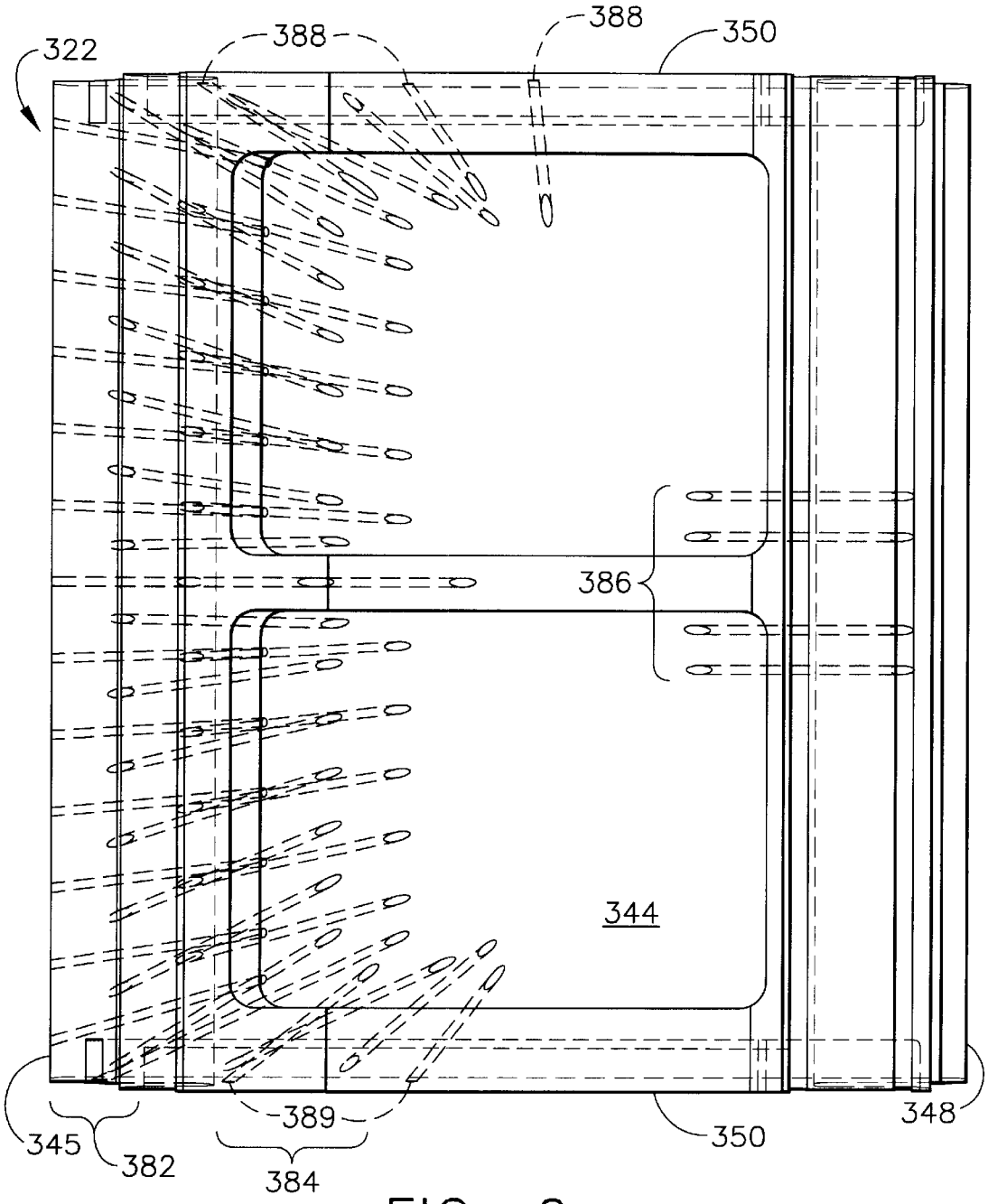
FIG. 6 (PRIOR ART)
FIG. 6 is a plan view of yet another prior shroud.
Figure 7:
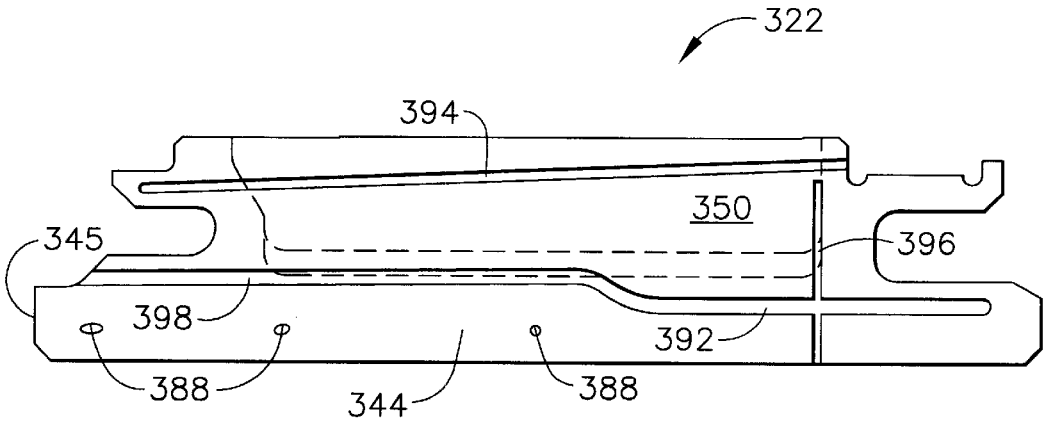
FIG. 7 (PRIOR ART)
FIGS. 7 and 8 are different side views of the prior shroud of FIG. 6.
Figure 8:
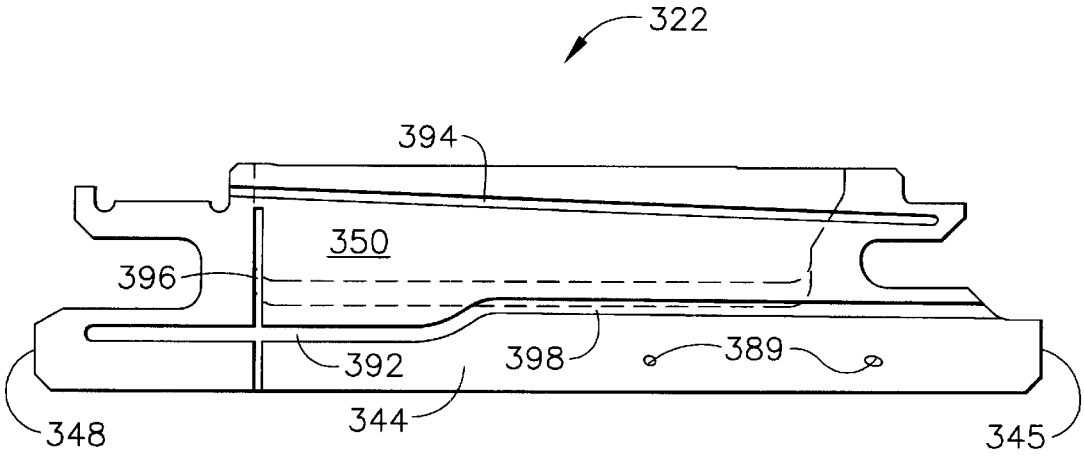
FIG. 8 (PRIOR ART)
Figure 9:
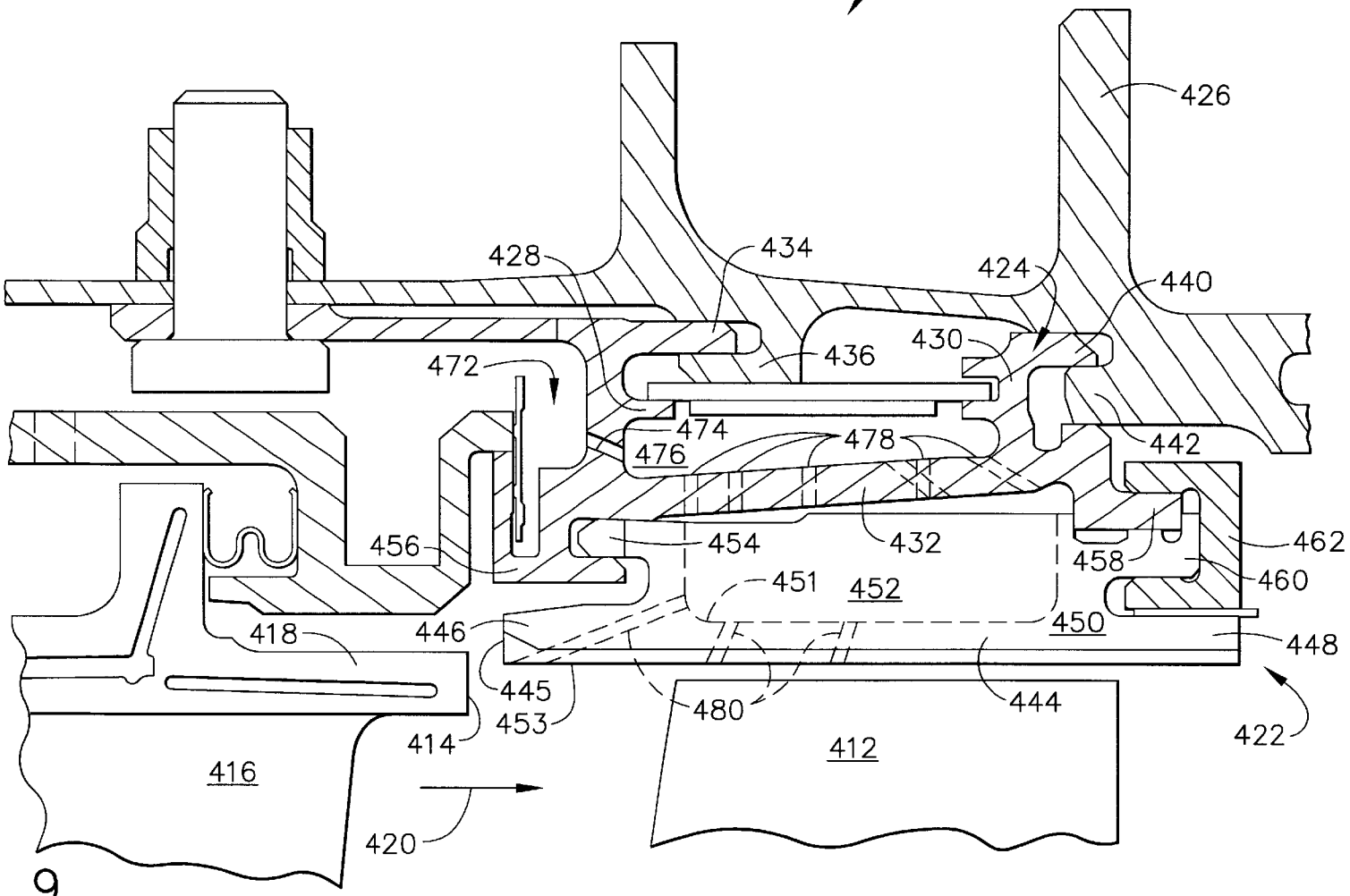

Referring to the drawings, FIG. 9 shows turbine cooling subassembly of the present invention in the form of a shroud assembly generally indicated at 410, disposed in closely surrounding relation with turbine blades 412 carried by the rotor (not shown) in the high pressure turbine section of a gas turbine engine. A turbine nozzle, generally indicated at 414, includes a plurality of vanes 416 affixed to an outer band 418 for directing the main or core engine hot gas stream, indicated by arrow 420, from the combustor (not shown) through the high pressure turbine section to drive the rotor in traditional fashion.

Shroud cooling assembly 410 includes a shroud in the form of an annular array of arcuate shroud segments, one generally indicated at 422, which are held in position by an annular array of arcuate hanger sections, one generally indicated at 424, and, in turn, are supported by the engine outer case, generally indicated at 426. More specifically, each hanger section includes a fore or upstream rail 428 and an aft or downstream rail 430 integrally interconnected by a body panel 432. The fore rail 428 is provided with a rearwardly extending flange 434 which radially overlaps a forwardly extending flange 436 carried by the outer case 426. Similarly, the aft 430 rail is provided with a rearwardly extending flange 440 in radially overlapping relation with a forwardly extending outer case flange 442 to the support of the hanger sections from outer case 426.

Figure 10:
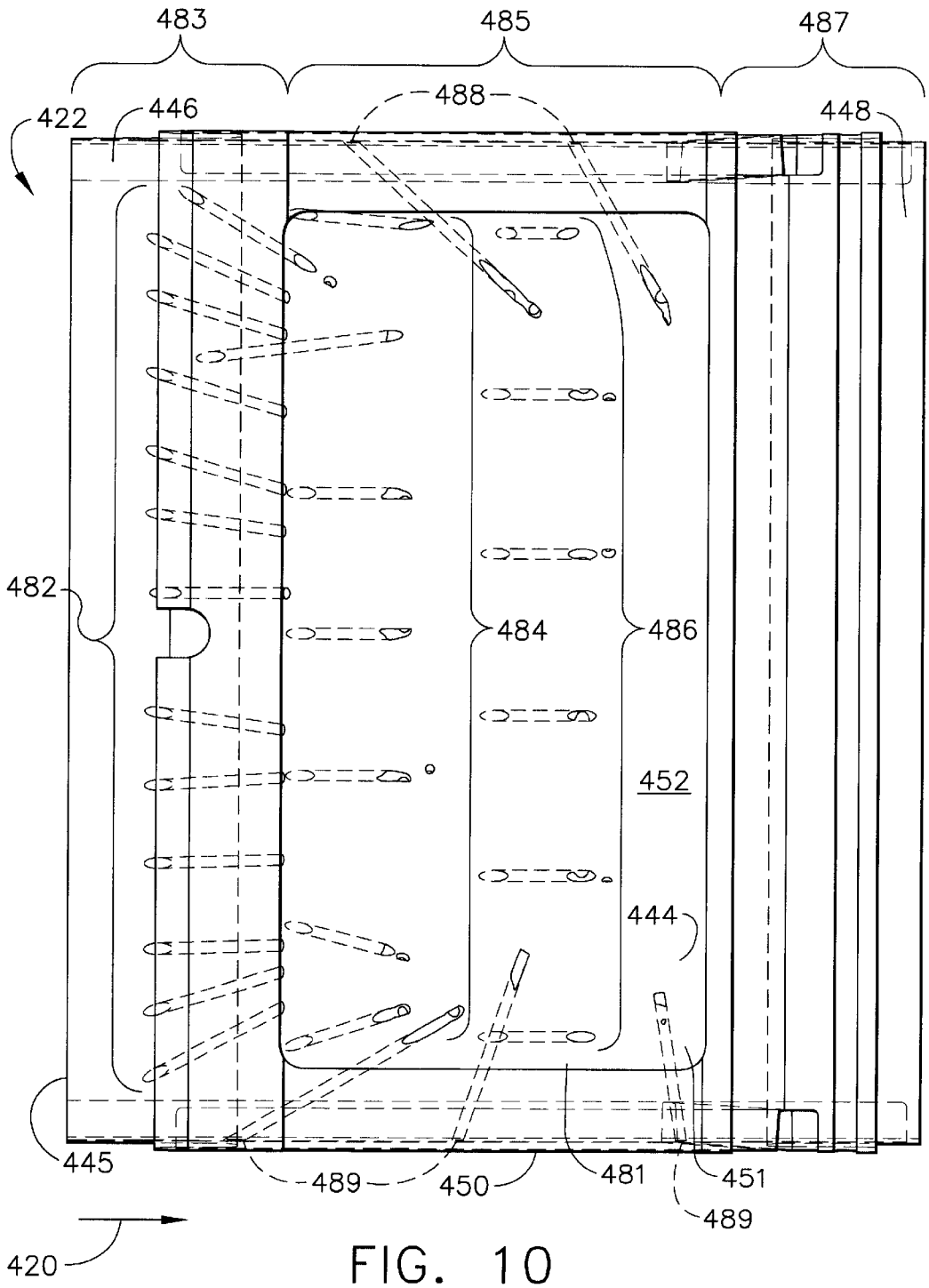
FIG. 10 is a plan view of an embodiment of the shroud segment of the present invention.

Each shroud segment 422 is provided with a base 444, a fore rail 446 radially and forwardly extending from base 444 that defines a circumferential leading edge of shroud segment 422, an aft rail 448 radially and rearwardly extending from base 444 that defines a circumferential trailing edge of shroud segment 442, and angularly spaced side rails or panels 450 radially outwardly extending from base 444. As seen in FIGS. 9 and 10, base 444, fore rail 446, aft rail 448 and side panels 450 define a shroud segment cavity or plenum 452. Shroud segment fore rail 446 is provided with a forwardly extending flange 454 which overlaps a flange 456 rearwardly extending from hanger section fore rail 428 at a location radially inward from flange 434. A flange 458 extends rearwardly from hanger section aft rail 430 at a location radially inwardly from flange 440 and is held in lapping relation with an underlying flange 460 rearwardly extending from shroud segment aft rail 448 by an annular retaining ring 462 of C-shaped cross section.

In practice, each hanger section typically mounts two shroud segments 422. High pressure cooling air extracted from the output of a compressor (not shown) immediately ahead of the combustor is routed to a nozzle plenum 472 from which cooling air is forced through a metering hole 474 provided in the hanger section fore rails 428. The metering hole 474 then conveys cooling air from the nozzle plenum 472 into an upper plenum 476 and then through holes 478 in body panel 432 to provide cooling airstreams that impinge on the back or radially outer surface 451 of base 444 of each shroud segment 422. The impingement cooling air then flows through a plurality of elongated holes or passages 480 in FIG. 9 that extend from outer surface 451 of base 444 and through base 444 of each shroud segment 442 to provide convection cooling of the shroud. Each of these holes or passages then exit (through outlets) from front or radially inner surface 453 of base 444, radial forward end surface 445 of fore rail 446 or side panels 450. Upon exiting these convection cooling holes or passages, the cooling air flows rearwardly with the hot gas stream along the inner surface 453 of base 444 to further provide film cooling of the shroud.

The convection cooling holes or passages 480 are provided in a predetermined location pattern illustrated in FIG. 10 so as to maximize the effects of the three cooling modes, i.e., impingement, convection and film cooling, while at the same time minimizing the amount of compressor high pressure cooling air required to maintain shroud temperatures within tolerable limits. The pattern of impingement holes 478 in body panel 432 is such that the cooling airstreams impinge on shroud back or outer surface 451 of base 444 generally over an impingement cooling area of shroud cavity or plenum 452 having a generally rectangular shape as indicated by 481.

As shown in FIGS. 9 and 10, the location pattern for most of the cooling passages 480 is generally in three rows, indicated by lines 482, 484 and 486 that exit, respectively the forward surface 445 of fore rail 446 and inner surface 453 of base 444. It is seen that all of the passages 480 are straight, typically laser drilled, and extend in directions skewed relative to the engine axis, the circumferential direction and the radial direction. This skewing affords the passages greater lengths, significantly greater than the base and rail thicknesses, and increases their convection cooling surfaces. As can be seen in FIG. 10, several of the cooling passages of row 484 are skewed away from or opposed to the direction of the main (hot) gas stream (see arrow 420) imparted by the high pressure nozzle vanes 416 (see FIG. 9). Consequently ingestion of the hot gases from this stream into these passages in counterflow to the cooling air is minimized. The number of convection cooling passages shown in FIG. 10 for row 482 (13 passages), 484 (7 passages) and 486 (6 passages) is representative and can be altered as needed or desired.

As shown in FIG. 10, shroud segment 422 has a forward or leading section indicated generally as 483, a midsection indicated generally as 485 and an aft or trailing section indicated generally as 487. Air flowing through the passages of row 482, after impingement cooling of the back or outer surface 451 of base 444 convection cools forward section 483 of the shroud. Having served these purposes, the cooling air mixes with the main (hot) gas stream and flows along inner surface 453 to film cool the shroud. The passages of rows 484 and 486 also convey impingement cooling air, which then serves to convection cool the forward to midsections 483 to 485 of the shroud. Upon exiting these passages in rows 484 and 486, this cooling air mixes with the main hot gas stream and flows along the inner surface 453 to film cool the shroud.

It will be noted from FIGS. 9 and 10 that the shroud segment rails 446, 448 and 450 effectively frame those portions of the shroud segments 422 immediately surrounding the turbine blades 412. Impingement cooling of these rails by the airstreams issuing from impingement holes 478 reduces heat conduction out into the shroud support structure. These framed shroud portions, however, are afforded minimal film cooling since cooling air flowing along the inner shroud surfaces 453 is continuously being swept away by the turbine blades. It is seen from FIG. 10 that impingement cooling (area 481) is concentrated on these framed shroud portions to compensate for the loss in film cooling. In addition, the inlets of the row 482 and row 484 passages are contiguously positioned at the hotter forward part of the framed shroud portions to take advantage of the maximum convection heat transfer characteristics thereat.

The portions of the shroud segments 422 upstream from the turbine blades are effectively convection cooled by the cooling air flowing through the passages of rows 482 and 484 and film cooled by the cooling air exiting therefrom. It is seen that no cooling air from the passages in rows 482, 484 and 486 is utilized to cool the aft shroud section 487 downstream from the turbine blades, as the temperature of the main gas stream at this point has dropped dramatically due to expansion during flow through the high pressure turbine section. Also, film cooling at this location is extremely detrimental to engine performance, since it is essentially wasted.

In certain prior shroud cooling designs, the location of the convection cooling passages has tended to concentrate the cooling air exiting from passages having outlets in the side panels in the leading or forward section of the shroud. As a result, less cooling of the shroud has typically occurred in the midsection where the main (hot) gas stream tends to be the hottest. In addition, in certain prior shroud cooling designs, the convection cooling passages exit only one of the side panels, so that impingement cooling primarily occurs only to one of the side panels of the adjacent pair of shroud segments. Also, in certain prior shroud cooling designs, the orientation of the convection cooling passages is such that it increases the risk of hot gas ingestion that can lead to local oxidation and burning of the shroud.

These problems of prior shroud designs are minimized or avoided by the pattern of cooling air holes or passages 480 of the present invention that exit side panels 450, as illustrated in the embodiment shown in FIG. 10. As shown in FIG. 10, a set of two passages, indicated as 488, extend through and have outlets exiting from one of the side panels 450 to direct impingement cooling air against the side panel of the adjacent shroud segment. As also shown in FIG. 10, another set of three passages, indicated as 489, extend through and have outlets exiting from the other side panel 450 to direct impingement cooling air against the side panel of another adjacent shroud segment. The convection cooling of the side panels and the impingement cooling of the side panels of adjacent shroud segments beneficially serve to reduce heat conduction through the side panels into the hanger and engine outer case. In addition, passages 488 and 489 that exit side panels 450 in the midsection 485 and forward section 483 are skewed such that cooling air exiting therefrom flows in a direction opposed to the main gas stream (see arrow 420). This is effective in reducing the ingestion of hot gases that can lead to oxidation and burning of the shroud. As also shown in FIG. IO, the cooling air passage 489 that has an outlet that exits in the aft section 487 can be skewed in a direction such that the cooling air exiting flows in the same general direction as the main hot gas stream 420; by the time main gas stream reaches the aft section 487 of the shroud, it is much cooler and the gas pressure is lower such that hot gas ingestion is not a significant problem.

Figure 11:
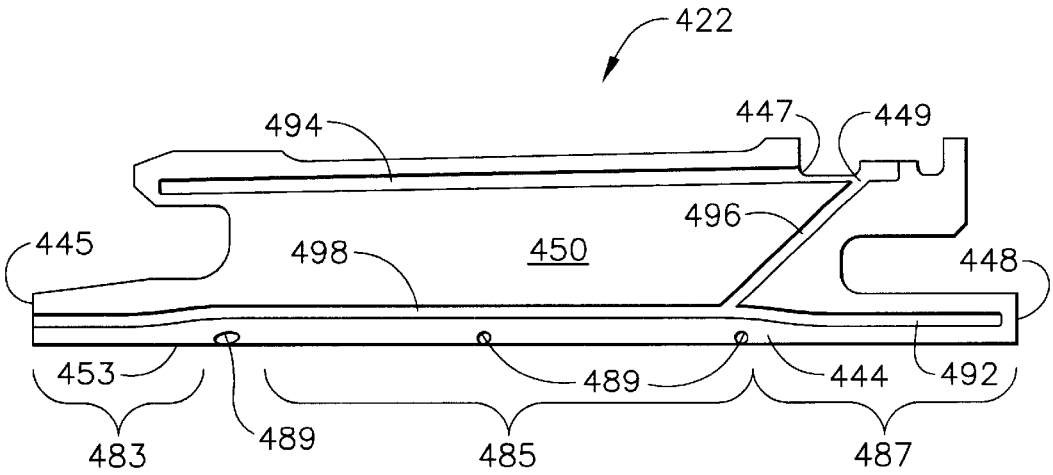
FIGS. 11 and 12 are different side views of the shroud segment embodiment shown in FIG. 10.
Figure 12:
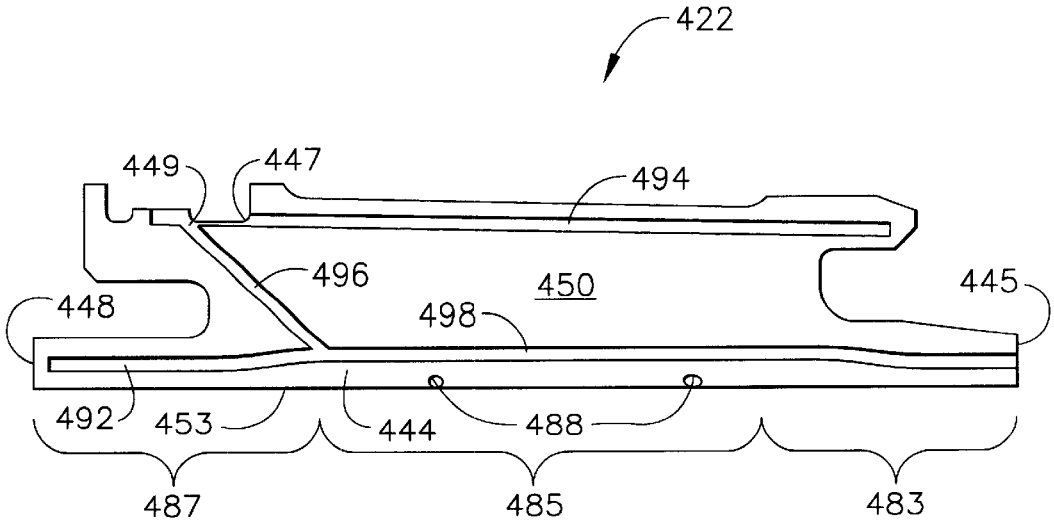

Another preferred feature of the shroud segment of the present invention is shown in FIGS. 11 and 12. As shown in FIGS. 11 and 12, each side panel 450 of shroud segment 422 has formed therein a bottom spline seal slot 492 at the bottom of panel 450, a top or upper spline seal slot 494 spaced from and above bottom slot 492 that pressurizes and reduces the leakage of cooling air out of shroud cavity or plenum 452 and a back or aft spline seal slot 496 that prevents hot gas from reaching C-clip 462, thus avoiding thermal fatigue and cracking of this C-clip.

As shown in FIGS. 11 and 12, the length of bottom slot 492 extends generally from the beginning of leading section 483 to almost the end of trailing section 487. As also shown in FIGS. 11 and 12, the length of top or upper slot 494 extends generally from almost the beginning of leading section 483 to a point indicated by 447 of aft rail 448 almost at the end of trailing section 487. As also shown in FIGS. 11 and 12, aft slot 496 is connected at its bottom end to bottom slot 492 at about the juncture of midsection 485 and aft section 487 of shroud segment 422 and extends its length generally diagonally and upwardly towards the upper edge of aft section 487 of aft rail 448 until its top end intersects a point indicated by 449 near aft rail 448. The length, as well as the width, of each of slots 492, 494 and 496 are such that they can receive the respective spline seals.

As also shown in FIGS. 11 and 12, bottom slot 492 has a plateau shaped or "humped" section that begins at about the aft end forward section 483, extends to include all of midsection 485 and ends at about the forward end of aft section 487. As shown in FIGS. 11 and 12 and of particular importance to the present invention is that humped section 498 curves upwardly before reaching outlets of cooling air passages 488 (see FIG. 12) and 489 (see FIG. 11) that have outlets that exit from the side panels 450, extends above and across all of the outlets of passages 488 and 489 and then curves downwardly once past the outlets of passages 488 and 489.

Figure 13:
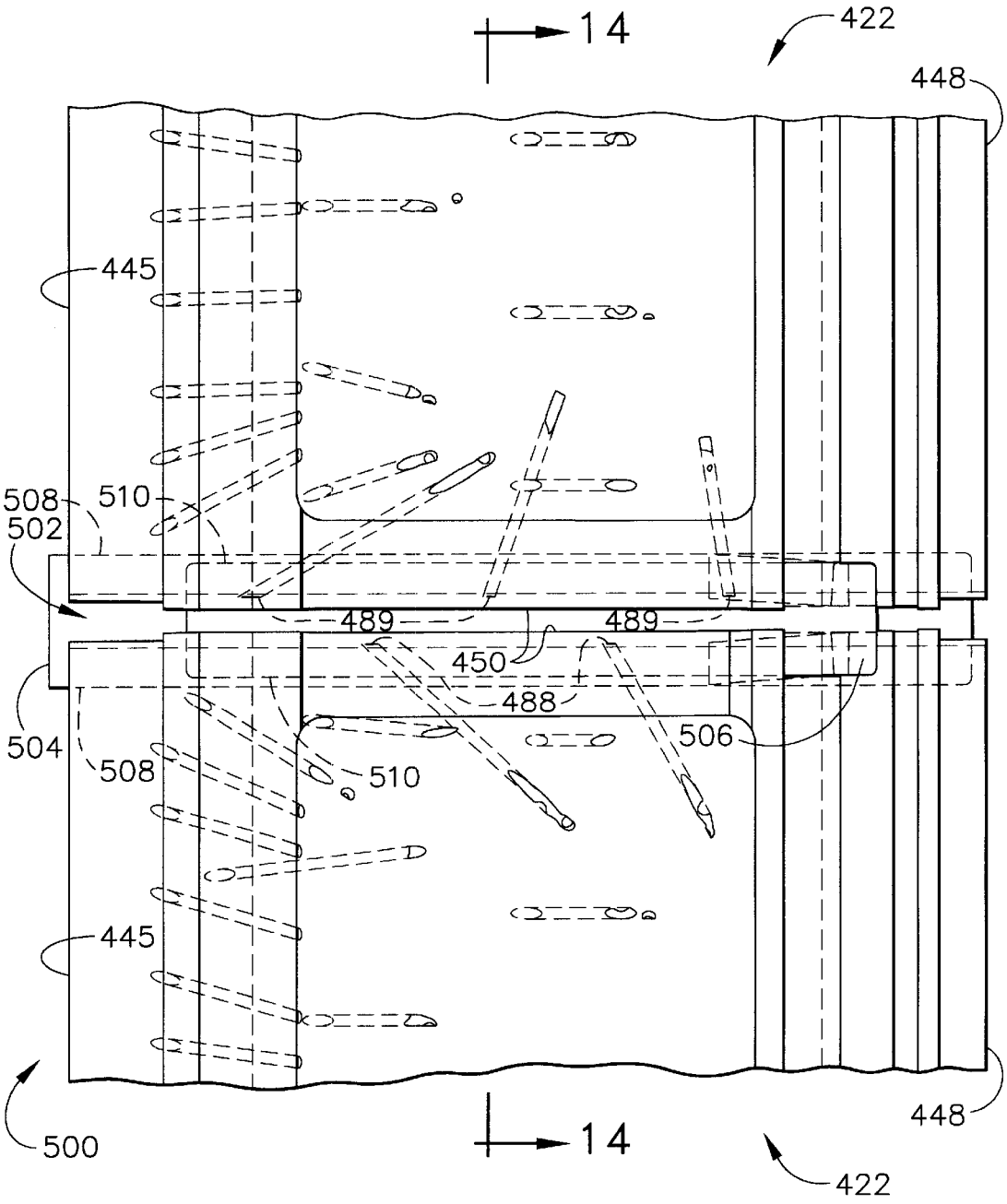
FIG. 13 is a plan view of an embodiment of the shroud subassembly of the present invention with portions broken away.
Figure 14:
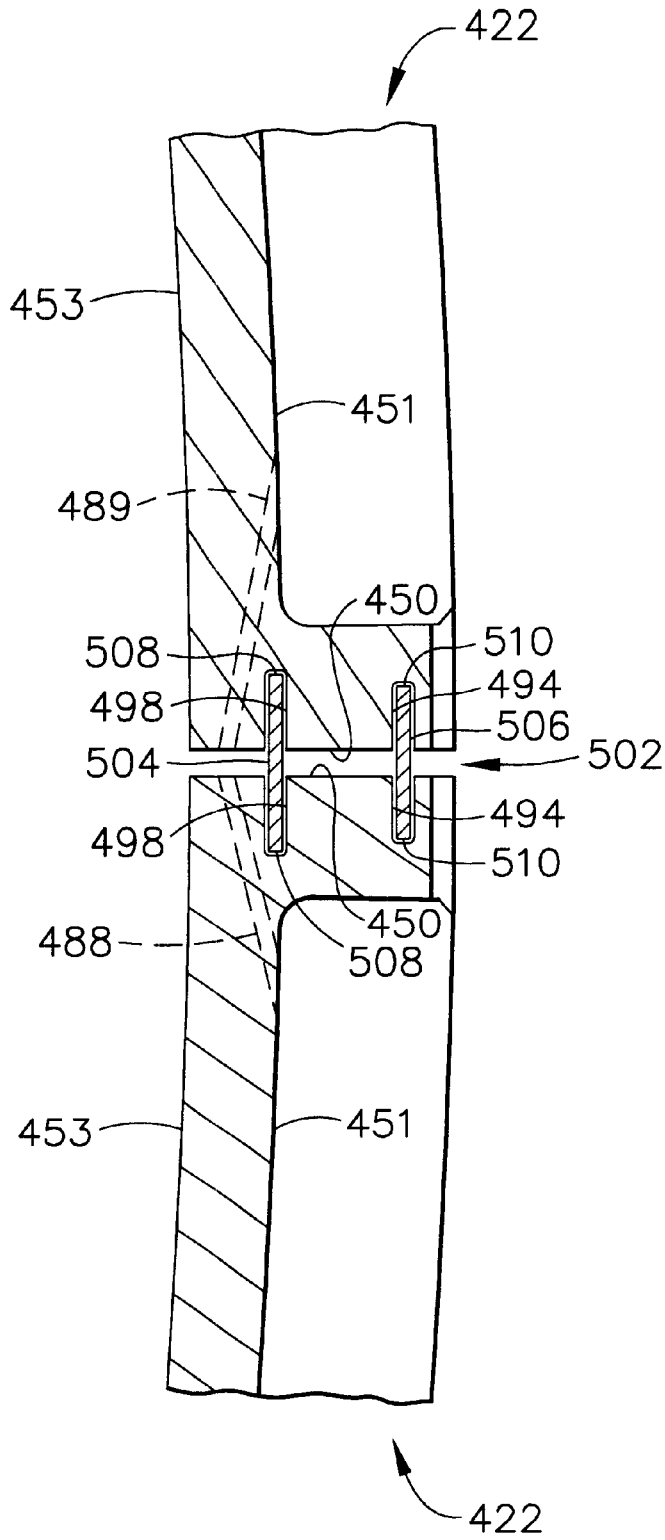
FIG. 14 is a sectional view taken along line 14—14 of FIG. 13.

Another aspect of the present invention is the shroud subassembly, an embodiment of which is shown in FIGS. 13 and 14 and is indicated generally 500. Shroud subassembly 500 comprises a pair of adjacent shroud segments 422 that have opposed adjacent side panels 450 that are separated by a gap indicated generally as 502. As shown in FIG. 13, the cooling passages 488 having outlets exiting from one of the adjacent side panels 450 are spaced to be staggered or offset relative to cooling passages 489 having outlets exiting from the other adjacent side panel 450. As a result, the outlets of passages 488 are not directly opposite the outlets of passages 489, and thus provide more effective, efficient and uniform impingement cooling for each of the adjacent shroud segments 422, especially with regard to the midsection 485 of each of the adjacent side panels 450.

As also shown in FIGS. 13 and 14, bottom spline seal 504 and top spline seal 506 are positioned in gap 502, along with an aft spline seal 508 (not shown). These spline seals each have, respectively, a pair of spaced edges 508 (for bottom seal 504) and 510 (for top seal 506) having a length and thickness such that each of the edges 508 and 510 is capable of being received by the respective bottom and top slots 492 and 494. (The aft seal that is not shown would also have similar edges for being received by aft slot 496.) While seals 504 and 506 are each shown as being one continuous piece, they can also be separate sections.

The spline seal that fits within the respective bottom slots 492 of the adjacent side panels 450 assumes the "humped" or "hooded" configuration of section 498 of slot 492 at this position in gap 502. As a result, cooling air exiting the outlets of passages 488 and 489 of the adjacent side panels 450 tends to be localized at about the midsection 485 of each of the adjacent shroud segments 422, thus provide more effective and efficient cooling at what tends to be the hottest point of the main gas stream 420. Also, because bottom slot 492 and especially the forward end thereof in forward section 483 (as well as the respective portion of seal 504) is lower down on side panel 450 (i.e., proximate or closer to inner surface 453), the area of the leading edge 445 of the shroud exposed to hot gas from the main gas stream 420 is less.

From the foregoing detailed description, it is seen that the present invention provides a shroud cooling assembly wherein three modes of cooling are utilized to maximum thermal benefit individually and interactively to maintain shroud temperatures within safe limits. The interaction between cooling modes is controlled such that at critical locations where one cooling mode is of lessened effectiveness, another cooling mode is operating at near maximum effectiveness. Further, the cooling modes are coordinated such that redundant cooling of any portions of the shroud is avoided. Cooling air is thus utilized with utmost efficiency, enabling satisfactory shroud cooling to be achieved with less cooling air. Moreover, a predetermined degree of shroud cooling is directed to reducing heat conduction into the shroud support structure to control thermal expansion thereof and, in turn, afford active control of the clearance between the shroud and the high pressure turbine blades.

While specific embodiments of the present invention have been described, it will be apparent to those skilled in the art that various modifications thereto can be made without departing from the spirit and scope of the present invention as defined in the appended claims.

What is claimed is:

1. A turbine cooling component for a turbine engine, which comprises:

(a) a circumferential leading edge;

(b) a circumferential trailing edge spaced from the leading edge;

(c) an arcuate base connected to the trailing and leading edges and having a back surface and an arcuate inner surface that is in contact with the main hot gas stream of the turbine engine moving in the direction from the leading edge to the trailing edge of the turbine component;

(d) a pair of spaced opposed side panels connected to the leading and trailing edges, each of the side panels having a leading section, a midsection and trailing section;

(e) a plurality of cooling air passages extending through the base from the back surface thereof and having outlets exiting from at least one of the leading edge, the side panels and the inner surface of the base;

(f) wherein all of the plurality of cooling air passages having outlets that exit from the leading or midsections of each side panel are skewed so that cooling air exits therefrom in a direction opposed to the main hot gas stream;

(g) wherein at least one of the plurality of cooling air passages is an impingement cooling air passage, which has an outlet that exits from the midsection of one of the side panels and wherein at least another of the plurality of cooling air passages is an impingement cooling air passage, which has an outlet that exits from the midsection of the other side panel, and (h) a spline seal slot that extends from the leading section to the trailing section of each side panel, the slot having a humped section in at least the midsection of the side panel that is above and across at least the outlets of the cooling air passages exiting from the midsection of the side panel.

2. The turbine component of claim 1 wherein at least two of the plurality of cooling air passages have outlets that exit from the leading or midsections of each side panel.

3. The turbine component of claim 2 wherein the outlets of the cooling air passages exiting from the leading or midsections of each of the side panels are spaced such that outlets of the cooling air passages exiting from one side panel are staggered relative to the outlets of the cooling air passages exiting from the other side panel.

4. The turbine component of claim 3 wherein the slot having the humped section is at the bottom of the side panel.

5. The turbine component of claim 4 wherein the humped section of the bottom slot curves upwardly before reaching the outlets of the cooling air passages exiting from the side panel, extends above and across all the outlets of the cooling air passages exiting from the side panel and then curves downwardly once past all of the outlets of the cooling air passages exiting from the side panel.

6. The turbine component of claim 5 wherein each of the side panels further has a top spline seal slot spaced from and above the bottom slot, the top slot extending generally from almost the beginning of the leading section to almost the end of the trailing section of each side panel.

7. The turbine component of claim 6 wherein each of the side panels further has an aft spline seal slot connected at its bottom end to the bottom slot at about the juncture of the midsection and the trailing section of the shroud segment and extending generally diagonally and upwardly towards the upper edge of the trailing section.

8. The turbine component of claim 1 which is a high pressure turbine shroud segment.

9. A turbine cooling subassembly for a turbine engine, which comprises:

(a) a pair of adjacent turbine cooling components, each of the turbine components comprising:
  (1) a circumferential leading edge;
  (2) a circumferential trailing edge spaced from the leading edge;
  (3) an arcuate base connected to the trailing and leading edges and having a back surface and an arcuate inner surface that is in contact with the main gas stream of the turbine engine moving in the direction from the leading edge to the trailing edge of the turbine component;
  (4) a pair of spaced opposed side panels connected to the leading and trailing edges, each of the side panels having a leading section, a midsection and trailing section;
  (5) a plurality of cooling air passages extending through the base from the back surface thereof and having outlets exiting from at least one of the leading edge, the side panels and the inner surface of the base;
  (6) wherein all of the plurality of cooling air passages that have outlets that exit from the leading or mid-sections of each side panel are skewed so that the cooling air exits therefrom in a direction opposed to the main hot gas stream; and
  (7) wherein at least one of the plurality of cooling air passages has an outlet that exits from the midsection of each side panel;

(b) wherein opposed adjacent side panels of the pair of turbine components have a gap therebetween and wherein the outlets of cooling air passages exiting from each of the adjacent side panels is spaced such that outlets of each cooling air passage exiting from one of the adjacent panels is not directly opposite the outlets of the cooling air passages exiting from the other of the adjacent panels;

(c) each of the opposed adjacent side panels of the pair of shroud segment having a spline seal slot that extends from the leading section to the trailing section of the side panel, the slot having a humped section in at least the midsection of the side panel that is above and across at least the outlets of the cooling air passages exiting from the midsection of the side panel; and (d) at least one spline seal positioned in the gap between the opposed adjacent side panels and including a pair of spaced edges having a length and thickness such that each of the edges is capable of being received by the slot of one of the adjacent side panels.

10. The turbine subassembly of claim 9 wherein at least two of the plurality of cooling air passages have outlets that exit from the leading or midsections of each adjacent side panel.

11. The turbine subassembly of claim 10 wherein the slot is at the bottom of each adjacent side panel.

12. The turbine subassembly of claim 11 wherein the humped section of the bottom slot curves upwardly before reaching the outlets of the cooling air passages exiting from each adjacent side panel, extends above and across all the outlets of the cooling air passages exiting from each adjacent side panel and then curves downwardly once past all of the outlets of the cooling air passages exiting from each adjacent side panel.

13. The turbine subassembly of claim 12 wherein each of the adjacent side panels further has a top spline seal slot spaced from and above the bottom slot, the top slot extending generally from almost the beginning of the leading section to almost the end of the trailing section of each adjacent side panel and wherein the at least one spline seal further comprises a top spline seal having a pair of spaced edges having a length and thickness such that each of the edges is capable of being received by the top slot of one of the adjacent side panels.

14. The turbine subassembly of claim 13 wherein each of the adjacent side panels further has an aft spline seal slot connected at its bottom end to the bottom slot having at about the juncture of the midsection and the trailing section of the shroud segment and extending generally diagonally and upwardly towards the upper edge of the trailing section and wherein the at least one spline seal further comprises an aft spline seal having a pair of spaced edges having a length and thickness such that each of the edges is capable of being received by the aft slot of one of the adjacent side panels.

15. The turbine subassembly of claim 9 which is a shroud cooling subassembly for a high pressure turbine and wherein the turbine components are high pressure turbine shroud cooling segments.

* * * * *